US006824296B2

(12) United States Patent
Souza et al.

(10) Patent No.: US 6,824,296 B2
(45) Date of Patent: Nov. 30, 2004

(54) NIGHT LIGHT ASSEMBLY

(75) Inventors: Michael Souza, Fall River, MA (US); Wilson Brunkhurst, N. Attleboro, MA (US); John Ferreira, Fall River, MA (US); Anthony Pacitto, East Providence, RI (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 82 days.

(21) Appl. No.: 10/188,533

(22) Filed: Jul. 2, 2002

(65) Prior Publication Data

US 2004/0004839 A1 Jan. 8, 2004

(51) Int. Cl.[7] ..... F21V 1/10
(52) U.S. Cl. ..... 362/282; 362/322
(58) Field of Search ..... 362/226, 187, 362/282, 319, 322, 385, 183, 147, 432, 250, 269; 439/21, 365; D26/26, 72

(56) References Cited

U.S. PATENT DOCUMENTS 5,352,122 A * 10/1994 Speyer et al. ..... 439/13
5,420,764 A * 5/1995 Hussain et al. ..... 362/95
5,517,264 A * 5/1996 Sutton ..... 353/119
5,727,953 A * 3/1998 Pasholk ..... 439/21
6,276,813 B1 * 8/2001 Victor ..... 362/226
6,561,677 B1 * 5/2003 Leen ..... 362/276
2003/0076680 A1 * 4/2003 Stekelenburg ..... 362/276

* cited by examiner

*Primary Examiner*—Sandra O'Shea
*Assistant Examiner*—Hargobind S. Sawhney
(74) *Attorney, Agent, or Firm*—Paul J. Sutton

(57) ABSTRACT

The present invention pertains to a night light assembly which plugs directly into a wall receptacle to provide a beam of light that can be directed along different paths. The assembly comprises a base member having a plug with projecting blades for insertion into a wall receptacle, a light sensor for automatically controlling activation and de-activation of the lamp of the nightlight and cover member rotatably supported by the base member. The cover member includes a lens, a low wattage lamp located within a lamp support member. The low wattage lamp is coupled via sliding contacts to the PCB board-blade contacts assembly in the base member. This arrangement allows the cover member and lamp to rotated as a unit relative to the base member without limitation. The lamp support member is non-rotatably coupled to the cover member and is rotatably coupled to the base member. The longitudinal axis of the low wattage lamp located in the lamp support member is aligned along the rotational axis of the lens of the cover to maximize the amount of direct and reflected light that is passed through the lens in the cover without obstruction of light by the lamp base. The disclosed assemblage is a new improved night light of simple design which, in addition to providing increased light, can be manufactured and sold at relatively low cost.

11 Claims, 3 Drawing Sheets

NIGHT LIGHT ASSEMBLY

BACKGROUND OF THE INVENTION

1. Field of the Invention

The present invention relates generally to lights that are used to provide low level illumination in a room or passageway during the night, and more particularly to a night light assembly which provides a focused bean of light that can be easily and selectively oriented from a rotatable assembly to shine in different directions.

2. Description of the Related Art

Night lights which can be plugged into wall receptacles are normally used to provide low level illumination in a dark room or hallway. When used in a bedroom, a night light can provide sufficient light to allow a person, upon waking, to move about the room without banging into furniture, a doorway or such and still provide an ideal environment for sleeping. Where the bedroom is a child's nursery, a minimum amount of light in usually desirable. Very young children are often fearful of complete darkness and, in addition, should a parent wish to check on the sleeping child without turning on the room light, a low intensity night light that is continuously on is most useful and desirable.

The conventional night light consists of an electrical assembly having an electrical socket integrated with a plug for insertion into a wall receptacle. A low wattage lamp is held in the socket and a small translucent shade is usually provided to shield the lamp from direct view. A night light of this type normally uses a low wattage lamp which provide low level illumination. Light from the shielded bulb is normally reflected off an adjacent wall surface into the room to provide localized illumination that is purely utilitarian in function. The light is neither focused nor directionally controllable.

The patent to Victor, U.S. Pat. No. 6,200,001 illustrates a night light assembly which allows light from a small wattage lamp within the fixture to pass through a lens into the room. The beam of light emitted from the assembly can be directed by grasping and rotating a member containing a lens.

In the foregoing patent, the night light assembly has a stationary lamp which is positioned traverse to the rotational axis of the rotatable lens and, therefore, the filament of the lamp is not centered with the lens. With this arrangement, the base of the lamp interferers with and blocks reflected light from passing through the lens. In addition, the stationary lamp is hard wired to a PCB board that in turn is mechanically fastened to the prongs of the plug which not only increases the cost of manufacture of the assembly, but prevents the bulb from rotating with the head member.

A rotatable night light assembly that can direct a focused beam of light in different directions from a lamp aligned along the rotational axis of the lens to provide increased illumination, that is of a simple design and can be manufactured and sold at a relatively low cost is clearly desirable.

SUMMARY OF THE INVENTION

In one embodiment, the present invention pertains to a night light assembly which plugs directly into an electrical wall receptacle to provide a beam of light that can be directed along different paths. The assembly comprises a housing having a plug with projecting blade contacts for insertion into a wall receptacle and a light sensor for automatically controlling the activation and de-activation of the lamp of the nightlight. A cover member rotatably supported by the housing includes a lens, a low wattage lamp, a support member, and a lamp retaining member.

The low wattage lamp in the cover assembly is coupled, via sliding contacts, to the blade contacts in the base housing. This arrangement allows the cover and the lamp to be rotated as a unit relative to the base housing without limitation. The lamp retaining member is non-rotatably coupled to the cover and is rotatably engaged by a retaining member fixed to the housing member. The longitudinaal axis of the low wattage lamp located in the lamp retaining member is aligned along the rotational axis of the lens in the cover to permit both direct and reflected light without being obstructed by the base of the lamp to pass through the lens in the cover. The disclosed assemblage is a new improved nightlight of simple design which provides increased light and can be manufactured and sold at relatively low cost.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which:

DETAILED DESCRIPTION

Figure 1:
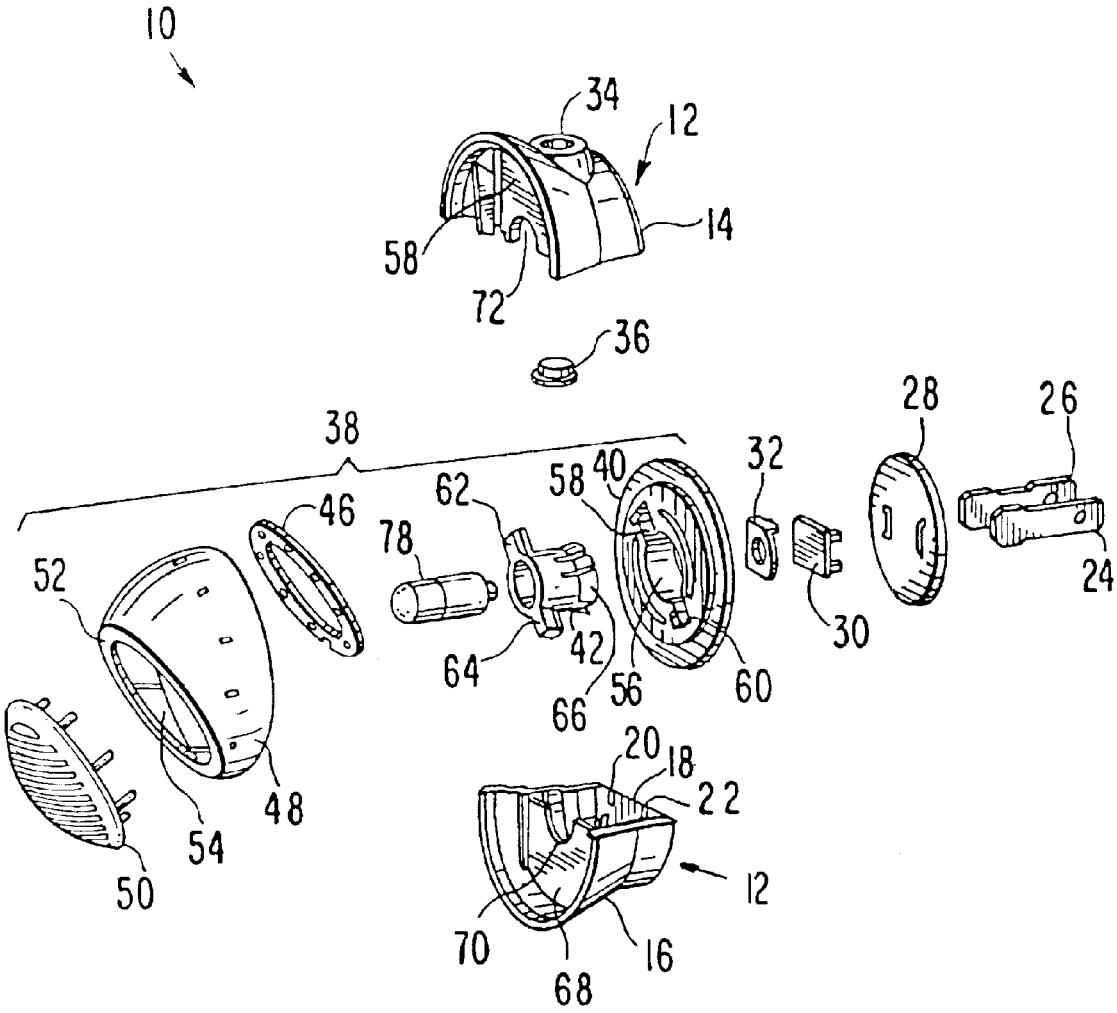
FIG. 1 is an exploded view of the embodiment of the invention.

Referring to FIG. 1, there is disclosed an exploded view of an embodiment of a night light in accordance with the principles of the invention, generally designated by numeral 10. The assembly 10 is adapted to be plugged into a wall receptacle located in a bedroom, a nursery or any other room or passageway in which the use of a night light is needed to provide low level illumination for safety, convenience or for any other reason. The assembly includes a base member 12 and a cover member 38. The base member consists of a first section 14 and a mating second section 16. The base member 12, sections 14 and 16 each includes a rear wall 18 having two openings 20, 22 for receiving a hot blade contact 24 and a neutral blade contact 26. A Printed Circuit Board (PCB) assembly 28 is mechanically connected to the rear ends of the blade contacts and located against the inside surface of the wall 18 helps to lock the blades to the base member 12, sections 14 and 16. A hot contact 30 and a neutral contact 32 are mechanically and electrically connected to the PCB assembly 28. The hot contact 30 is provided to make slidable contact with the center base contact of a low wattage lamp and neutral contact 32 makes slidable contact with the side base contact of the low wattage lamp. The first section 14 of base member 12 supports an opening 34 sized to accept and retain a light sensor lens 36 which in turn will house a light sensor (not illustrated) that is electrically connected (not illustrated) to the PCB assembly to control the flow of current to the low wattage lamp. In operation, the light sensor allows the lamp to be energized when the ambient light is below a predetermined level, and disconnects the lamp from the current source when the ambient light is above that level.

The cover member 38 consists of an internal support member 40 which provides support for a lamp support member 42 adapted to receive a low wattage lamp 78, a lens retaining ring 46, a cover 48 and a lens 50. The cover member is a unitary assemblage which is rotatably coupled to base member 12.

Referring to the cover member 38, lens 50 supports projecting fingers positioned around its periphery aligned to pass through the opening 54 located in a flange 52 of cover 48. The flange 52 defines the same opening 54 located in cover member 38 for passing light. A lens retaining ring 46 has openings located to receive the projecting fingers of the lens 50 to hold the lens 50 securely against the flange 52 of the cover 48.

Figure 2:
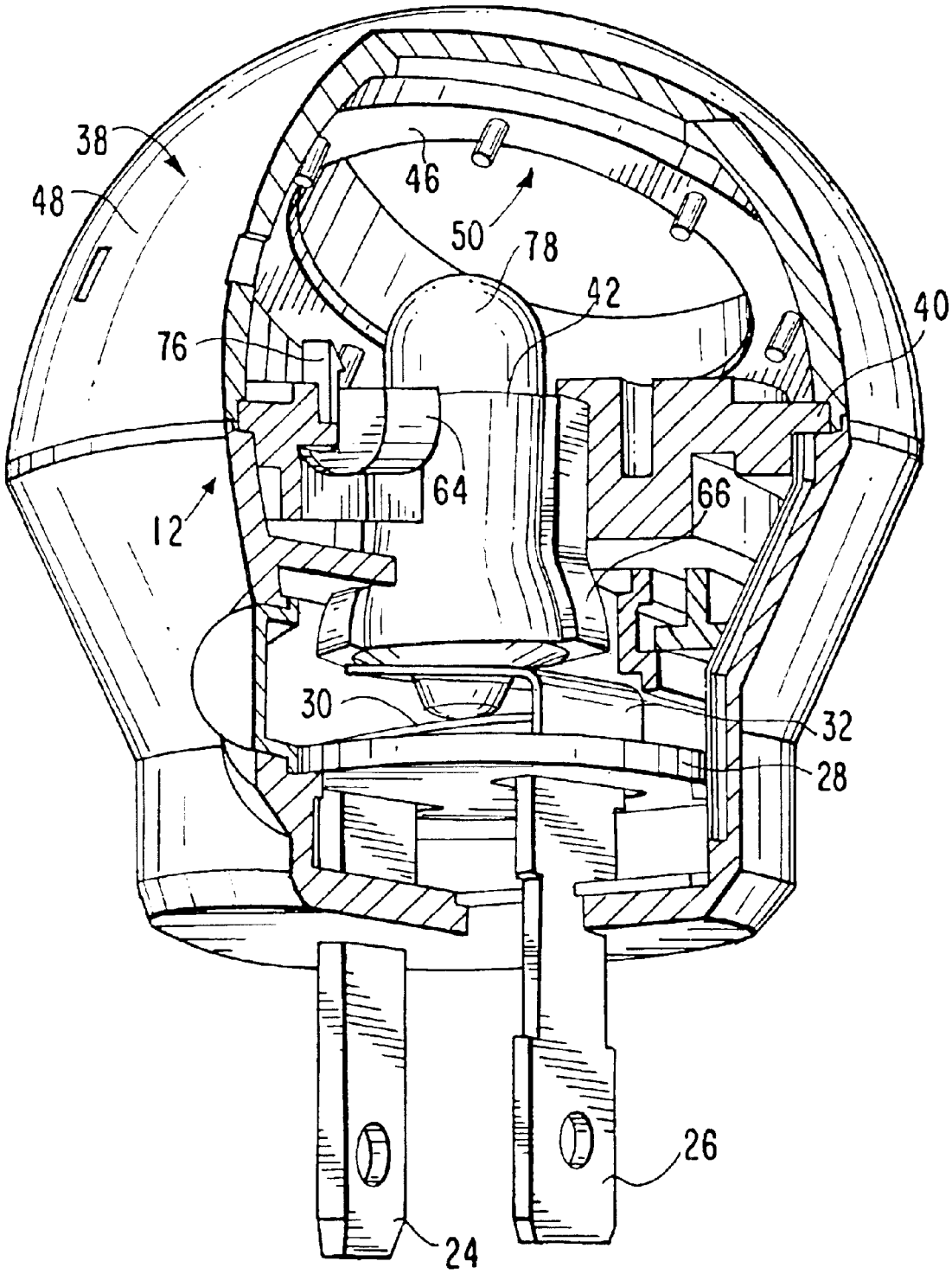
FIG. 2 is a partial cut away perspective view of an embodiment of the invention illustrating the relationship of the various components relative to each other.
Figure 3:
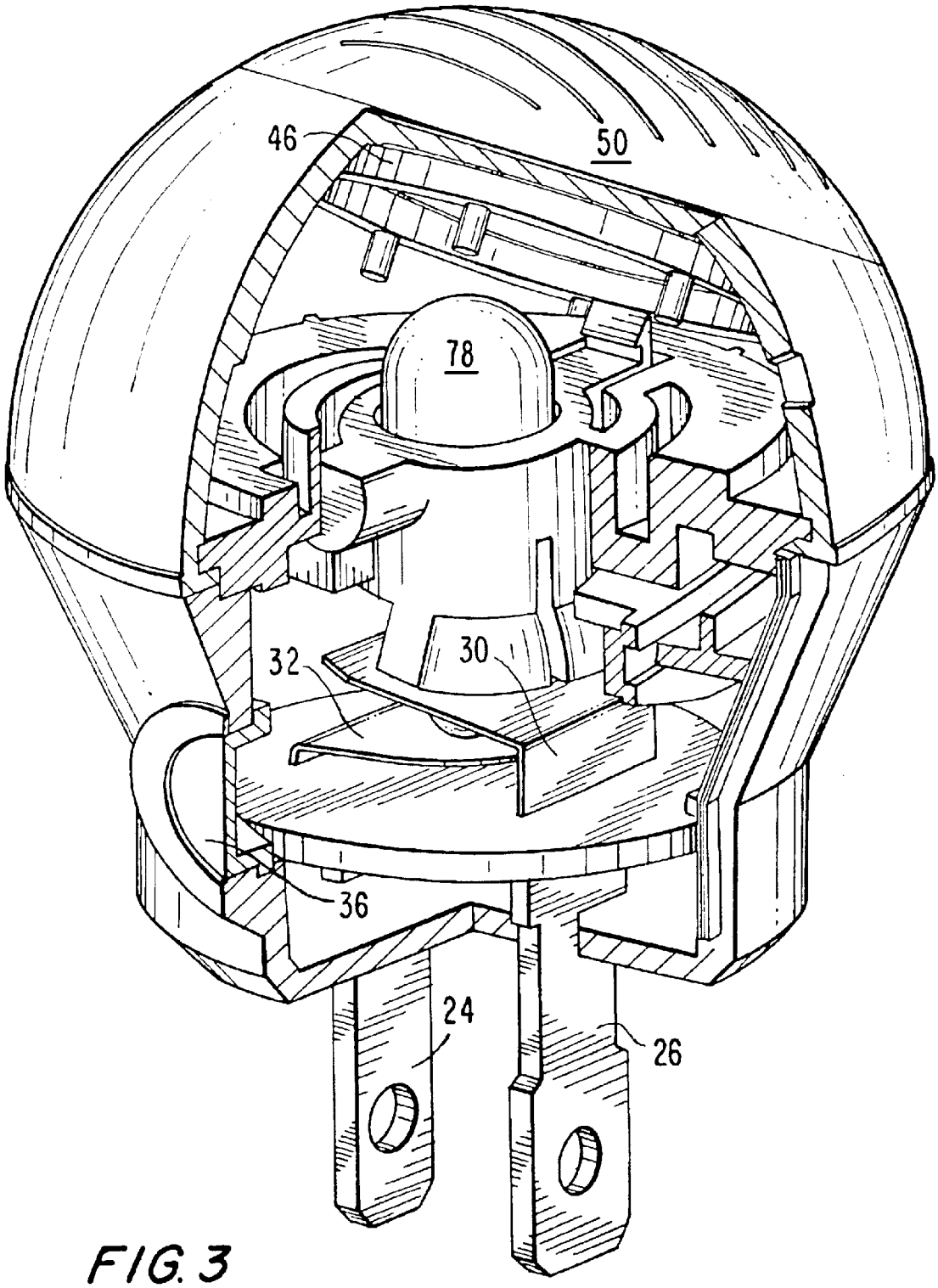
FIG. 3 is another partial cut away perspective view of the embodiment of the invention illustrating the relationship of the various components relative to each other.

Support member 40, which can be light in color to function as a reflecting body for light from the low wattage lamp, has an outside diameter sized to fit within an annular recess located within the rear end of cover 48. Support member 40 supports a centrally located opening 56 and opposing arm capturing and retaining recesses 58, 60 for capturing and holding the lamp support member 42. A latch member 76 located at an end of each recess 58, 60 is provided to engage an arm 62, 64 of the lamp support member 42 to hold it captive within the support member 40, see FIGS. 2 and 3.

The lamp support member 42 has, at a first end, two outwardly projecting arms 62, 64 designed to be received by recesses 58, 60 and held within the recesses by latch members 76 located at the end of each recess. The other or second end 66 of lamp support member is flared outward. A centrally located opening in lamp support member 42 defines a socket for receiving the low wattage lamp 78. Lamp 78 can be inserted into the centrally located socket of the lamp support member 42 from the first end, and projecting pins of the lamp engage channels in the socket to lock the lamp in position.

During assembly, the projecting fingers 50 are passed through the opening 54 in cover 48 and extend through corresponding openings of lens retaining ring 46 and is secured by, for example, ultrasonic welding, adhesive or the like, to lock the lens to the cover.

The flared end 66 of the lamp support member 42 is passed through the opening 56 in the support member 40 and held captive by outwardly projecting arms 62, 64 which are received by recesses 58, 60 and held in position by the latch members 76.

A low wattage lamp 78 is now positioned within the socket in the lamp support member 42. The support member 40, together with the captured lamp support member 42 and lamp 78 is secured to the cover 48 by, for example, ultrasonic welding, adhesive or the like.

The printed circuit board assembly 28 that is positioned over blades 24, 26 support electrical components thereon (not illustrated) required to enable a light sensor located behind light sensor lens 36 to control the on-off operation of the lamp 78 in response to ambient light. The ends of the hot blade contact 24 and neutral blade contact 26 project through the PCB assembly and are electrically and mechanically connected to hot contact 30 and neutral contact 32 respectively. The light sensor is positioned behind lens 36 which in turn is housed in opening 34 in the first section 14 of base member 12. The sub-assemblies of the cover member 38 and the first 14 and second 16 sections of the base member 12 are now ready to be joined together to form the night light.

This assembly is then positioned into base member 16 with both hot blade contact 24 and neutral blade contact 26 positioned within slot openings 22 and 20 respectively.

The flared second end 66 of the lamp support member 42 which protrudes from the cover assembly 38 is positioned within cutout 70 of retaining wall 68 of the second section 16 of base member 12. The cutout or opening 70 of the second section 16 is located between the back face of support member 40 and the start of the flared section of the second end of the lamp support member 42. The top section 14 is now positioned on top of the bottom section 16, care being taken to insure that cutout 72 of the retaining wall 68 of the top section is positioned between the back face of the support member 40 and the start of the flared section of the second end 66 of the lamp support member 42. The two sections 14, 16 are joined together by ultrasonic welding, or an adhesive or the like. It is to be noted that by positioning the lamp support member 42 within the openings 70, 72 of the first and second sections of the base member 12, the cover member 38 is rotatably coupled to base member 12 and the contacts of the lamp make slidable electrical contact with hot contact 30 and neutral contact 32. Thus, cover member 38, including the lamp, rotate together as a unitary unit, and can be rotated without limitation in either direction to allow a user to controllably direct a beam of light from a night light.

While there has been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

What is claimed is:

1. A night light comprising:

a base member having blade contacts for insertion into an electrical receptacle;

a first electrical contact coupled to a first blade contact and a second electrical contact coupled to a second blade contact wherein the first and second contacts are slidably coupled to base contacts of the lamp via a PCB board;

a cover member having a lens affixed thereto;

a lamp support member for receiving a lamp for emitting light through the lens, the lamp support member supports outwardly projecting protrusions adapted to be held captive by a support member of the cover member having an opening for receiving the lamp and being non-rotatably coupled to the cover member at a first end and rotatably coupled to the base member at a second end;

the base having a first section and a second section which connect together, wherein the first section has a first portion of a retaining wall and a first section of an opening, and the second section has a second portion of the retaining wall and a second section of the opening wherein the first and second sections of the opening support the second end of the lamp support member; and a light sensor coupled to the base member to control activation of the lamp in response to the ambient light level.

2. The night light of claim 1 wherein the second end of the lamp support member is funnel shaped.

3. The night light of claim 2 wherein the first and second sections of the opening fit around and are rotatably coupled to the second end of the lamp support member.

4. The night light of claim 1 further comprising:

a support member located within the cover member having a centrally located opening and recesses for receiving and holding captive the lamp support member.

5. The night light of claim 4 wherein the recesses support latch members engage and retain the first end of the lamp support member captive to the support member.

6. The night light of claim 5 wherein the first end of the lamp support member supports arms which fit within the recesses in the support member and are retained in place by the latch members.

7. The night light of claim 6 wherein the second end of the lamp support member supports a radially extending protrusion which rotatably engage a retaining wall of the base member.

8. The night light of claim 7 wherein the retaining wall of the base member rotatably engages the second end of the lamp support member between the radially extending protrusion and the support member of the cover member.

9. The night light of claim 8 wherein the radially extending protrusion at the second end of the lamp support member is an outwardly extending flange.

10. The night light of claim 8 wherein the radially extending protrusion at the second end of the lamp support member is funnel shaped.

11. The night light of claim 10 wherein the small diameter of the funnel shaped end of the lamp support member is coupled to the second end of the lamp support member.

* * * * *